US008391767B2

(12) United States Patent
Ito et al.

(10) Patent No.: US 8,391,767 B2
(45) Date of Patent: Mar. 5, 2013

(54) FUSING APPARATUS USED TO FUSE TONER IMAGE AND IMAGE FORMING APPARATUS

(75) Inventors: Takayuki Ito, Nagoya (JP); Shoichi Yoshikawa, Okazaki (JP); Kuniya Matsuura, Toyohashi (JP); Noboru Oomoto, Toyokawa (JP); Masayuki Satou, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 104 days.

(21) Appl. No.: 13/116,850

(22) Filed: May 26, 2011

(65) Prior Publication Data

US 2011/0299898 A1 Dec. 8, 2011

(30) Foreign Application Priority Data

Jun. 2, 2010 (JP) ..... 2010-127143

(51) Int. Cl.
*G03G 15/20* (2006.01)

(52) U.S. Cl. ..... 399/333

(58) Field of Classification Search ..... 399/69, 399/333, 328

See application file for complete search history.

(56) References Cited

U.S. PATENT DOCUMENTS

| | | | | |
|---|---|---|---|---|
| 5,724,638 | A | 3/1998 | Isogai et al. | |
| 7,433,619 | B2 * | 10/2008 | Suzuki et al. | 399/69 |
| 7,928,347 | B2 * | 4/2011 | Sako | 399/333 |
| 2003/0202826 | A1 * | 10/2003 | Yokoi et al. | 399/328 |
| 2006/0269308 | A1 * | 11/2006 | Ishii | 399/69 |
| 2009/0097873 | A1 * | 4/2009 | Biegelsen | 399/69 |
| 2011/0293343 | A1 * | 12/2011 | Satou et al. | 399/333 |

FOREIGN PATENT DOCUMENTS

| | | |
|---|---|---|
| JP | 4-79372 | 7/1992 |
| JP | 9-80952 | 3/1997 |
| JP | 10-319761 | 12/1998 |
| JP | 2003-323072 | 11/2003 |
| JP | 2006-337521 | 12/2006 |
| JP | 2007-171318 | 7/2007 |

OTHER PUBLICATIONS

Japanese Decision to Grant Patent mailed May 8, 2012, directed to counterpart Japanese Application No. 2010-127143, 6 pgs.

* cited by examiner

*Primary Examiner* — Susan Lee
(74) *Attorney, Agent, or Firm* — Morrison & Foerster LLP

(57) ABSTRACT

A fusing apparatus allows a recording member to pass through between a heat member and a pressure member, to transport and heat the recording member, and thereby fuses a toner image on the recording member. The fusing apparatus includes a temperature detector for detecting a surface temperature of the heat member in a non-contact manner. A surface of the heat member is configured such that a region of the surface all around a cylindrical configuration that faces a temperature detection area of the temperature detector has a higher emissivity than other regions.

12 Claims, 9 Drawing Sheets

FUSING APPARATUS USED TO FUSE TONER IMAGE AND IMAGE FORMING APPARATUS

This application is based on Japanese Patent Application No. 2010-127143 filed with the Japan Patent Office on Jun. 2, 2010, the entire content of which is hereby incorporated by reference.

BACKGROUND OF THE INVENTION

1. Field of the Invention

The present invention relates to a fusing apparatus, and more particularly to a fusing apparatus that fuses a toner image formed on a recording member, and an image forming apparatus including the fusing apparatus.

2. Description of the Related Art

Conventionally, in order to reduce power consumption in a fusing apparatus, for example, as described in Document 1 (Japanese Laid-Open Patent Publication No. 09-080952), a configuration is proposed in which a release layer provided on a surface of a heat member such as a heat roller is made of a material with a relatively low thermal emissivity and a relatively high thermal conductivity. With this, it is intended to suppress the quantity of heat radiated from the surface of the heat member.

In such a fusing apparatus, the surface temperature of the heat member affects the behavior of fusing of a toner image to a recording member, which in turn affects image formation quality on the recording member. Thus, control of the surface temperature is important. Note that in recent years, in a fusing apparatus such as that described above, in order to avoid the wearing away of the surface of the heat member, it has become more common to detect the surface temperature of the heat member by a non-contact sensor such as a thermopile.

In order to avoid the wearing away of the surface of the heat member, etc., the case of detecting the surface temperature of the heat member by a non-contact temperature sensor is considered. Meanwhile, when a release layer with a relatively low thermal emissivity is formed on the surface of the heat member, a change in the surface temperature of the heat member is difficult to be reflected in the amount of infrared rays emitted from the surface of the heat member. Due to this, when a conventional fusing apparatus attempts to detect the surface temperature of a heat member by a non-contact temperature sensor, a change in the surface temperature is difficult to be reflected in a change in detection output from the sensor, causing concerns about a reduction in the accuracy of temperature detection by the sensor.

SUMMARY OF THE INVENTION

The present invention is made in view of such circumstances, and an object of the present invention is therefore to improve the accuracy of detection of the surface temperature of a heat member while suppressing power consumption in a fusing apparatus or an image forming apparatus.

A fusing apparatus according to the present invention includes: a heat member including therein a heat source and having a cylindrical configuration; and a pressure member coming into contact with the heat member by pressure, and allows a recording member to pass through between the heat member and the pressure member, to transport and heat the recording member, and thereby fuses a toner image on the recording member. The fusing apparatus further includes a temperature detector for detecting a surface temperature of the heat member in a non-contact manner. A surface of the heat member is configured such that a region of the surface all around the cylindrical configuration that faces a temperature detection area of the temperature detector has a higher emissivity than other regions.

An image forming apparatus according to the present invention includes the above-described fusing apparatus.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
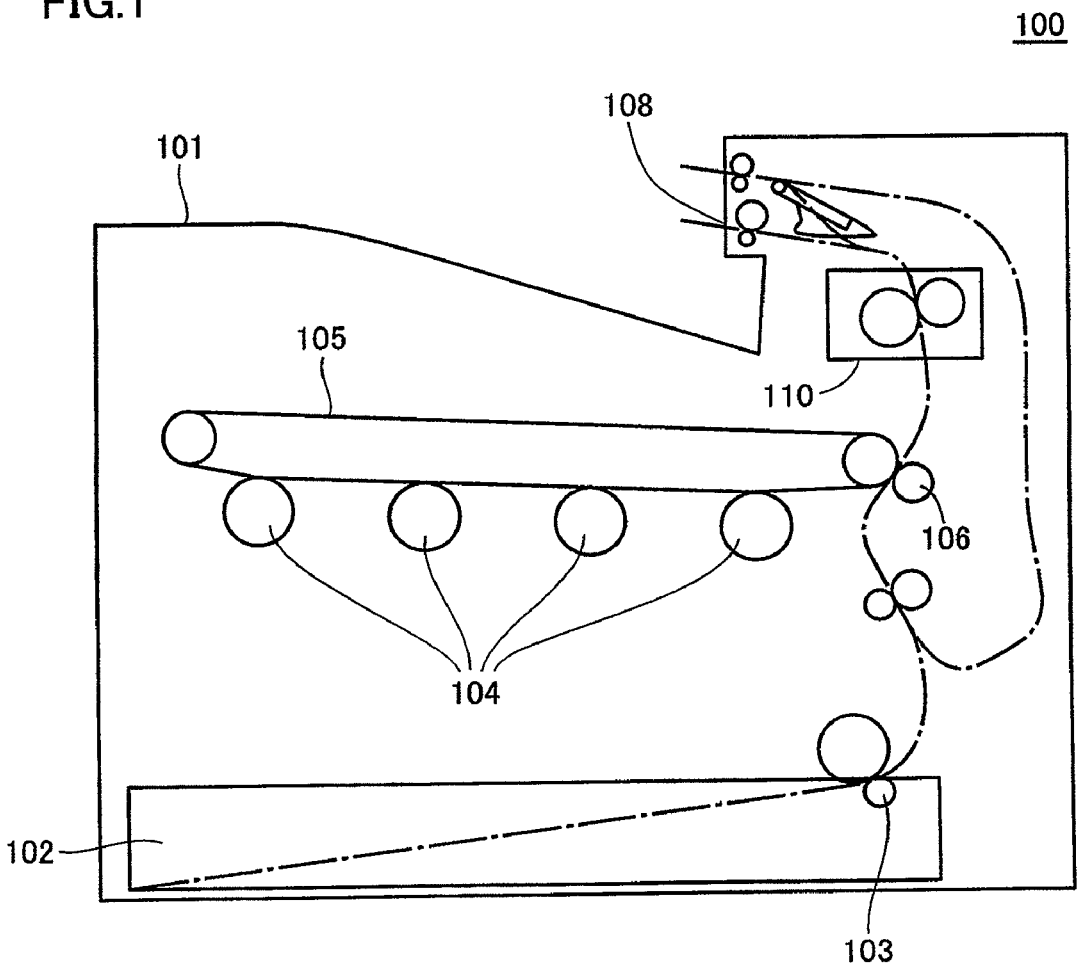
FIG. 1 is a diagram describing a configuration of an image forming apparatus including a fusing apparatus according to an embodiment of the present invention.

An embodiment of the present invention will be described below with reference to the drawings. Note that in the drawings those components having the same functions are denoted by the same reference numerals and description thereof is not repeated.

In the present embodiment, as an example of an image forming apparatus, a tandem-type color printer that forms color images is shown. Note that an image forming apparatus according to the present invention may be of any type as long as the image forming apparatus includes a fusing apparatus, and thus may be a monochrome printer.

[1. Overall Configuration of an Image Forming Apparatus]

FIG. 1 is a diagram describing a configuration of an image forming apparatus including a fusing apparatus according to the present embodiment. With reference to FIG. 1, an image forming apparatus 100 has an outer cover 101 to cover the entire apparatus body. A recording member printed in the apparatus body is ejected from a discharge opening 108.

In image forming apparatus 100, there are shown four photoconductor units 104 that, for example, rotate for image formation; an intermediate transfer belt 105 that sequentially stacks toner images formed in the transfer positions of respective photoconductor units 104 and transfers the toner images;

and a transfer roller 106 provided in a transfer position set around a moving surface of intermediate transfer belt 105.

Then, using paper feed rollers 103, a recording member stored in a paper feed cassette 102 is transported to the transfer position. Note that, though not shown, paper feed cassette 102 is provided with a sensor that detects whether there is a recording member. Thus, when paper feed cassette 102 is not set or when recording members run out, such an event is notified to a user by means of a display panel or the like, which is not shown.

In image forming apparatus 100, electrostatic latent images are formed on photoconductor units 104 based on image data to be printed on a recording member. Then, the electrostatic latent images formed on photoconductor units 104 are visualized with toner by development and are sequentially stacked on intermediate transfer belt 105. A toner image obtained as a result of electrostatic transfer onto intermediate transfer belt 105 and combining is electrostatically transferred onto a recording member at once in the transfer position by electrostatic suction by transfer roller 106. Then, the transferred paper (recording member) after the transfer is allowed to pass through a fusing apparatus 110, whereby heat and pressure are applied to fuse an image on the transferred paper. By this process, the image formation is completed. Thereafter, the recording member is discharged from discharge opening 108.

Figure 2:
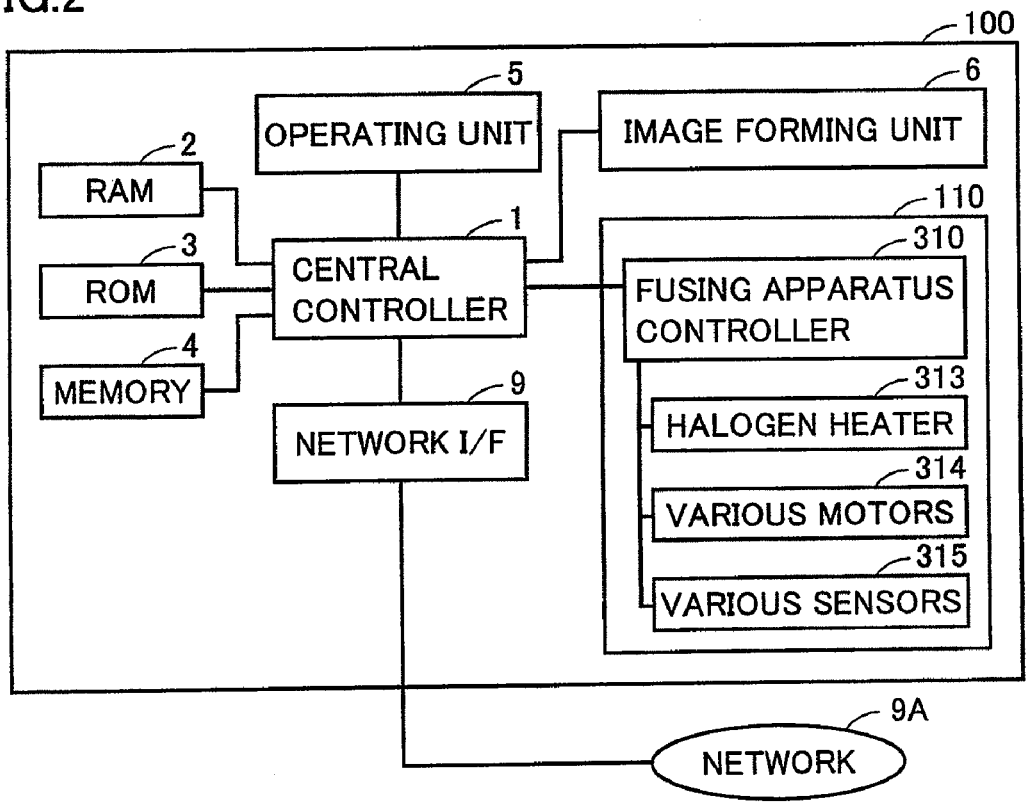
FIG. 2 is a block diagram of the image forming apparatus in FIG. 1.

FIG. 2 is a block diagram of image forming apparatus 100.

With reference to FIG. 2, image forming apparatus 100 includes a central controller 1 that performs overall control of the operation of image forming apparatus 100. Central controller 1 includes a CPU (Central Processing Unit).

In addition, image forming apparatus 100 includes a ROM (Read Only Memory) 3 containing data such as programs executed by central controller 1; a RAM (Random Access Memory) 2 serving as a working area when central controller 1 executes a program; a memory 4 that stores various data such as set values used when central controller 1 executes a program; an operating unit 5 including a display unit that displays the state of image forming apparatus 100 and an input unit such as buttons used to input information externally; and a network I/F (interface) 9 serving as an interface when performing communication with an external device through a network 9A.

In image forming apparatus 100, an image formation operation includes formation of electrostatic latent images onto photoconductor units 104, rotation of intermediate transfer belt 105, rotation of transfer roller 106, rotation of paper feed rollers 103, a process for a sensor detection signal indicating whether there is a recording member in paper feed cassette 102, etc. In the image formation operation, an image forming unit 6 performs a process starting with formation and development of electrostatic latent images and then transferring of a toner image onto a recording member in paper feed cassette 102 up to guiding the recording member into fusing apparatus 110, and a process up to discharging of the recording member having passed through fusing apparatus 110 from discharge opening 108. The operation of image forming unit 6 is controlled by central controller 1.

Fusing apparatus 110 includes a fusing apparatus controller 310 that performs overall control of the operation of fusing apparatus 110. In fusing apparatus 110, fusing apparatus controller 310 controls the operations of a halogen heater 313 and various motors 314 based on detection outputs from various sensors 315.

[2. Configuration of the Fusing Apparatus]

Figure 3:
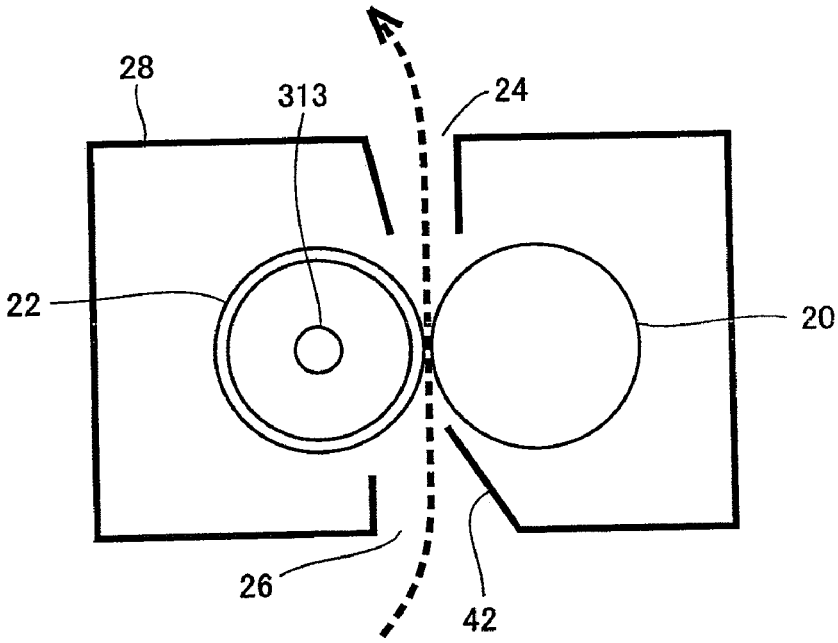
FIG. 3 is a diagram describing an internal configuration of the fusing apparatus in FIG. 1.
Figure 4:
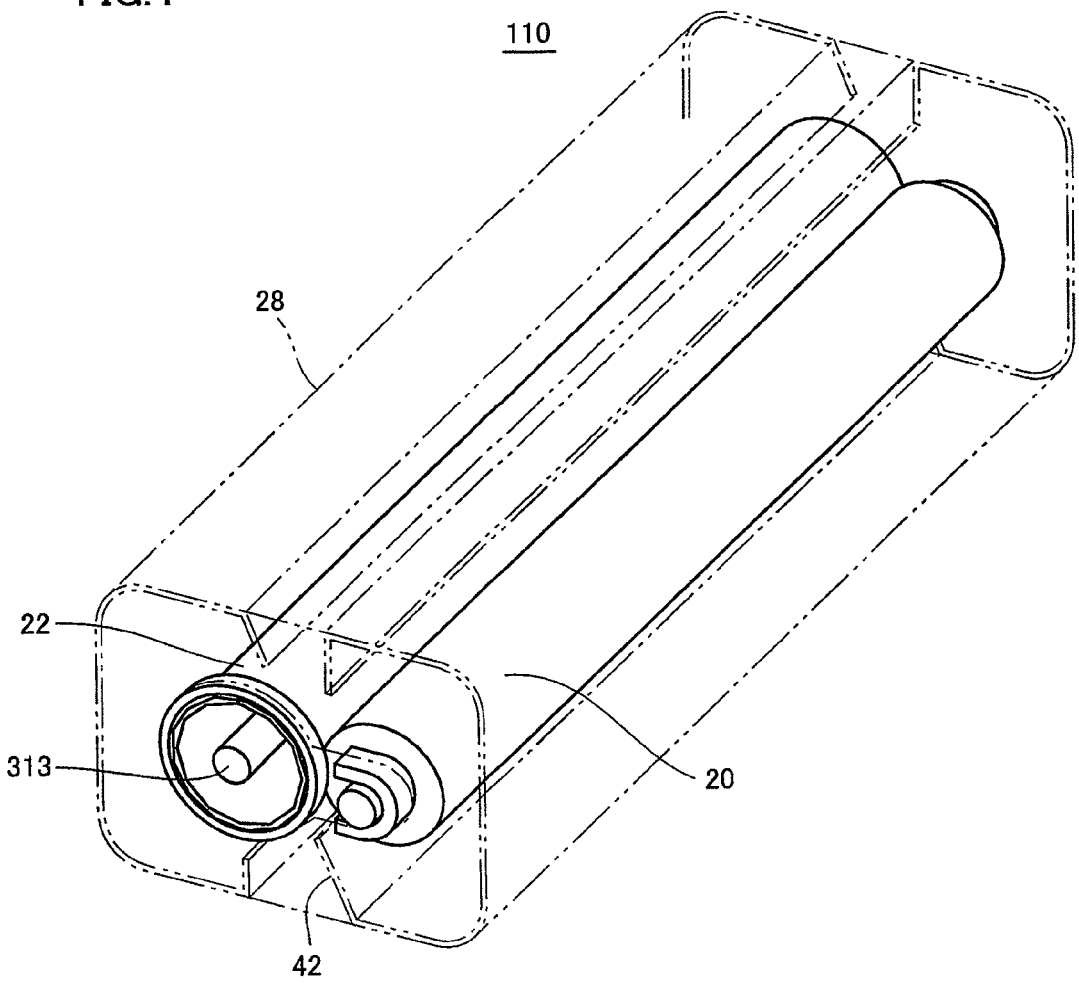
FIG. 4 is a perspective view of the fusing apparatus in FIG. 1.

FIG. 3 is a diagram describing an internal configuration of fusing apparatus 110 according to the embodiment of the present invention. FIG. 4 is a perspective view of fusing apparatus 110.

With reference to FIGS. 3 and 4, fusing apparatus 110 includes a casing 28 covering the exterior thereof. In fusing apparatus 110, an eject opening 24 is provided on the top side of casing 28 (the downstream side in a transport direction of a recording member (paper)), and a loading opening 26 is provided on the bottom side which is the opposite side of the top side (the upstream side in the transport direction of the recording member).

Loading opening 26 is provided with a guide member 42. Note that, when guide member 42 is configured to be driven by a drive mechanism, loading opening 26 can also function as a shutter that opens and closes.

In casing 28 are provided a heat roller (heat member) 22 including halogen heater 313; and a pressure roller (pressure member) 20.

A recording member loaded through loading opening 26 on the bottom side of casing 28 is heated and pressurized by heat roller 22 and pressure roller 20. With this, a toner image on the recording member is fused to the recording member. Thereafter, the recording member is sent out of fusing apparatus 110 through discharge opening 24.

In fusing apparatus 110, a recording member comes into contact with heat roller 22 and pressure roller 20 by pressure so as to form a nip region. The nip region is formed such that clearance is not created in any other region than where the recording member is present, when the recording member passes therethrough.

With further reference to FIG. 2, fusing apparatus 110 includes a temperature sensor (not shown) that detects a surface temperature of heat roller 22 and that is a temperature sensor 3150 and included in various sensors 315 which will be described later. Fusing apparatus controller 310 controls the on and of halogen heater 313 based on a temperature detected by the temperature sensor.

In addition, fusing apparatus controller 310 controls the drive of motors (not shown) that rotate heat roller 22 and pressure roller 20 and that are included in various motors 314, according to a timing at which a recording member is guided into fusing apparatus 110.

[3. Configuration of the Heat Roller]

(1) Overall Configuration of the Heat Roller

Figure 5:
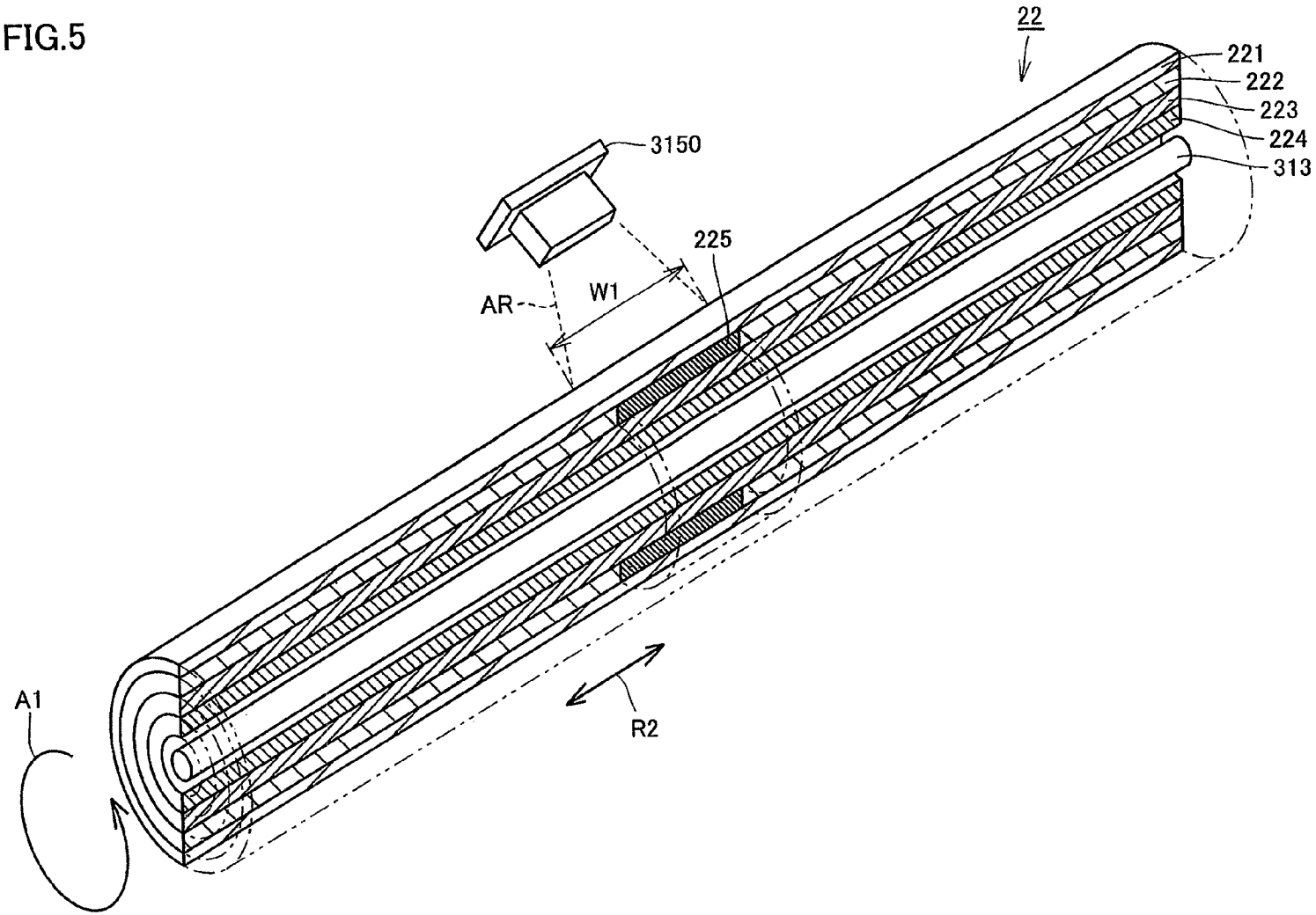
FIG. 5 is a partial cutaway perspective view of a heat roller in FIG. 3.
Figure 6:
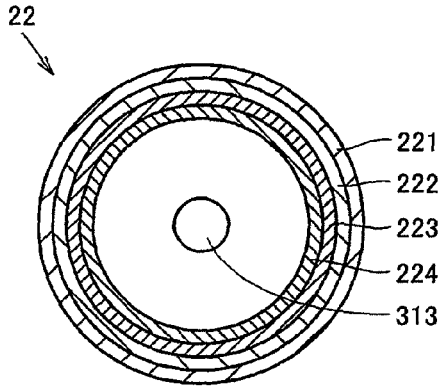
FIG. 6 is a cross-sectional view of the heat roller in FIG. 5.
Figure 7:
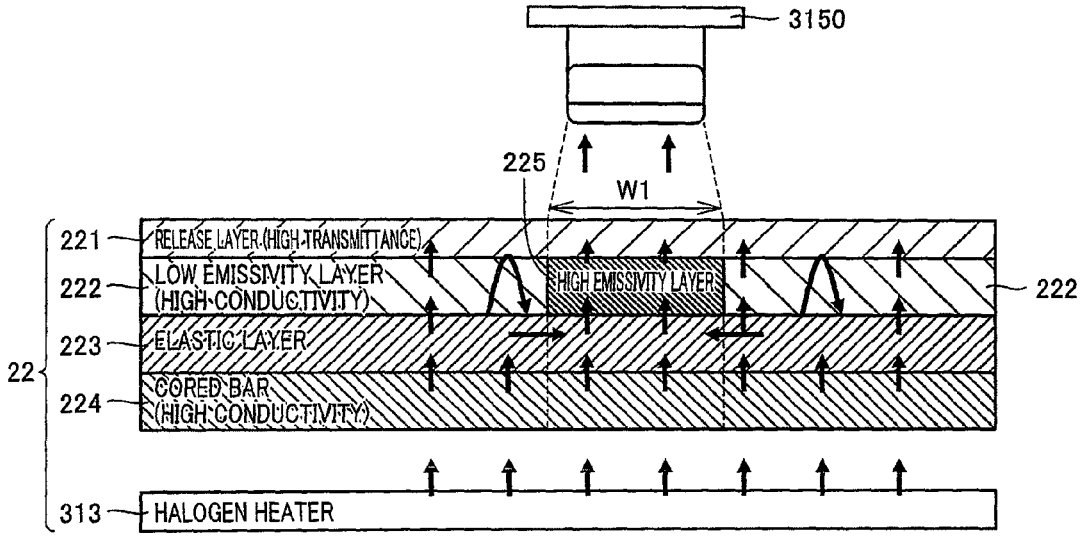
FIG. 7 is a diagram schematically showing a cross-sectional structure of the heat roller in FIG. 5.

FIG. 5 is a partial cutaway perspective view of heat roller 22. FIG. 6 is a cross-sectional view of heat roller 22. FIG. 7 is a diagram schematically showing a cross-sectional structure of heat roller 22.

With reference to FIGS. 5 to 7, heat roller 22 has a cylindrical external configuration. Halogen heater 313 is provided inside the cylinder. A longitudinal direction of halogen heater 313 is along a longitudinal direction of heat roller 22 (double headed arrow R2).

A hollow cylindrical cored bar 224 is provided in heat roller 22 so as to include therein halogen heater 313. An elastic layer 223, a low emissivity layer 222, and a release layer 221 are provided in this order on an outer part of cored bar 224.

An opening is provided in a part of low emissivity layer 222. In this opening portion, a high emissivity layer 225 is provided. The opening portion (i.e., the portion where high emissivity layer 225 is provided) is provided over the entire area in a rotation direction of heat roller 22 (arrow A1 in FIG. 5).

In FIG. 5, a temperature detection area is schematically shown by dashed lines AR. The size (width W1) of the portion in the longitudinal direction of heat roller 22 where high emissivity layer 225 is provided is the same as that of a region of a surface of heat roller 22 facing the temperature detection area of temperature sensor 3150. Temperature sensor 3150 is a sensor that performs temperature detection by a non-contact scheme, such as a thermopile, and that performs temperature detection based on the amount of electromagnetic waves such as infrared rays received.

(2) Configurations of the Layers

Cored bar 224 is made of a material with excellent thermal conductivity properties, such as aluminum. Elastic layer 223 is made of heat resistant elastic rubber such as silicone rubber or fluorine rubber.

Release layer 221 is made of a material with a high transmittance in an infrared wavelength range of 2 to 10 μm (e.g., PFA (tetrafluoroethylene-perfluoroalkylvinylether copolymer), PTFE (polytetrafluoroethylene), etc.). Note that a material forming release layer 221 is preferably such that the spectral emissivity in a radiation wavelength range (infrared region) of 2 to 10 μm is in a range of 0.10 to 0.65, and the thermal conductivity is in a range less than 0.2 cal/(deg·cm·s) and greater than or equal to 7.0×10-4 cal/(deg·cm·s). By forming release layer 221 using such a material, release layer 221 allows heat radiated from low emissivity layer 222 to be transmitted therethrough, thereby suppressing heat absorption (radiation) at release layer 221. Accordingly, energy is consumed only to melt toner by heat conduction, enabling to reduce wasteful energy release caused by radiation. It is preferable that the surface roughness of release layer 221 be adjusted to 40 μm or less. In addition, according to the Lambert-Beer law, since the thinner the layer, the higher the transmittance, it is preferable that the film thickness of release layer 221 be 30 μm or less.

Low emissivity layer 222 is made of a material with a lower emissivity than a material forming release layer 221, such as aluminum or copper.

High emissivity layer 225 is made of a material that does not melt under control temperatures (on the order of 150 to 200° C.) for fusing in fusing apparatus 110 and that has a relatively high thermal emissivity (e.g., 0.9 or more). Examples of such a material include polyimide resin, fluorocarbon resin, silicone resin, and polybenzimidazole resin.

In heat roller 22, low emissivity layer 222 and high emissivity layer 225 are formed, for example, by being coated on elastic layer 223 or release layer 221 by performing plating, deposition, thermal spraying, or the like, thereon in a predetermined pattern.

Arrows in FIG. 7 schematically indicate the movement paths of heat emitted from halogen heater 313.

Heat (infrared rays) radiated from halogen heater 313 is transmitted in turn through cored bar 224, elastic layer 223, and low emissivity layer 222. In heat roller 22, since low emissivity layer 222 with a relatively low emissivity is provided on the outside of elastic layer 223, heat radiation radiated in air is suppressed at times other than during melting of toner on a recording member guided into fusing apparatus 110. This is because by the provision of low emissivity layer 222, heat is reflected inside heat roller 22, reducing unwanted heat loss.

Note, however, that in high emissivity layer 225, heat is radiated at the surface of heat roller 22 at a higher rate than that for other portions in the longitudinal direction of heat roller 22. With this, heat is radiated at high efficiency only in a portion of heat roller 22 facing the temperature detection area of temperature sensor 3150. Accordingly, compared with the case in which high emissivity layer 225 is not provided, an improvement in the accuracy of detection of the temperature of heat roller 22 by temperature sensor 3150 is achieved.

(3) Disposition of the High Emissivity Layer

As described above, in heat roller 22, high emissivity layer 225 is provided over the entire area in the rotation direction (circumferential direction) of heat roller 22 and at a size corresponding, in the longitudinal direction of heat roller 22, to the temperature detection area of temperature sensor 3150. Specifically, the surface of heat roller 22 is configured such that the emissivity of electromagnetic waves in a region of the surface of heat roller 22 facing the temperature detection area (in particular, electromagnetic waves (infrared rays) in a wavelength range used for temperature detection in a fusing control temperature range) is higher than that in other regions. With this, the radiant quantity of infrared rays in the temperature detection area (electromagnetic waves in the wavelength range used to perform temperature detection in the fusing control temperature range) can be changed such that a change in the surface temperature of heat roller 22 is more prominently exhibited, over the case in which high emissivity layer 225 is not provided in heat roller 22 (the case in which low emissivity layer 222 is provided over the entire area in the longitudinal direction of heat roller 22). Accordingly, the accuracy of detection of the surface temperature of heat roller 22 by temperature sensor 3150 can be improved. From such a viewpoint, it is preferable that high emissivity layer 225 be provided to be larger than or equal to, in the longitudinal direction of heat roller 22, the temperature detection area.

However, if an area of heat roller 22 where low emissivity layer 222 is replaced by high emissivity layer 225 is large, then heat is more likely to be radiated at the surface of heat roller 22. Hence, when passing of paper is continuously performed in fusing apparatus 110, the fusing quality of toner on recording paper may be affected, and accordingly, the quality of an image formed on the recording paper may be affected. In addition, in order to make up for heat thus radiated, power consumption increases in fusing apparatus 110. Therefore, in heat roller 22, it is preferable from the viewpoint of a reduction in power consumption, energy saving, and a reduction in running costs that high emissivity layer 225 be provided only in a minimum necessary portion for an improvement in the accuracy of detection of the surface temperature, such as that described above.

Heat roller 22 described above is configured such that low emissivity layer 222 abuts on those portions of the back of release layer 221 (a surface of release layer 221 opposite to a surface of release layer 221 facing temperature sensor 3150) other than a portion of the back of release layer 221 facing the temperature detection area of temperature sensor 3150, and high emissivity layer 225 abuts on the portion of the back of release layer 221 facing the temperature detection area. With this, the surface of heat roller 22 is configured such that the emissivity is higher in a region thereof facing the temperature detection area of temperature sensor 3150 than in other regions.

In addition, in a portion on the back side of release layer 221 facing the temperature detection area, low emissivity layer 222 is replaced by high emissivity layer 225, which means that low emissivity layer 222 is provided in the entire area of the back side of release layer 221 except for the portion on the back side of release layer 221 facing the temperature detection area. Note that it is considered that in the portion where low emissivity layer 222 is removed, even if high emissivity layer 225 is not provided and thus such a portion is a space with no layers provided therein, or even if release layer 221 directly abuts on elastic layer 223, the emissivity can be made higher than that in other portions (in the longitudinal direction of heat roller 22).

[4. First Variant of the Heat Roller]

(1) Configuration of the Heat Roller

Figure 8:
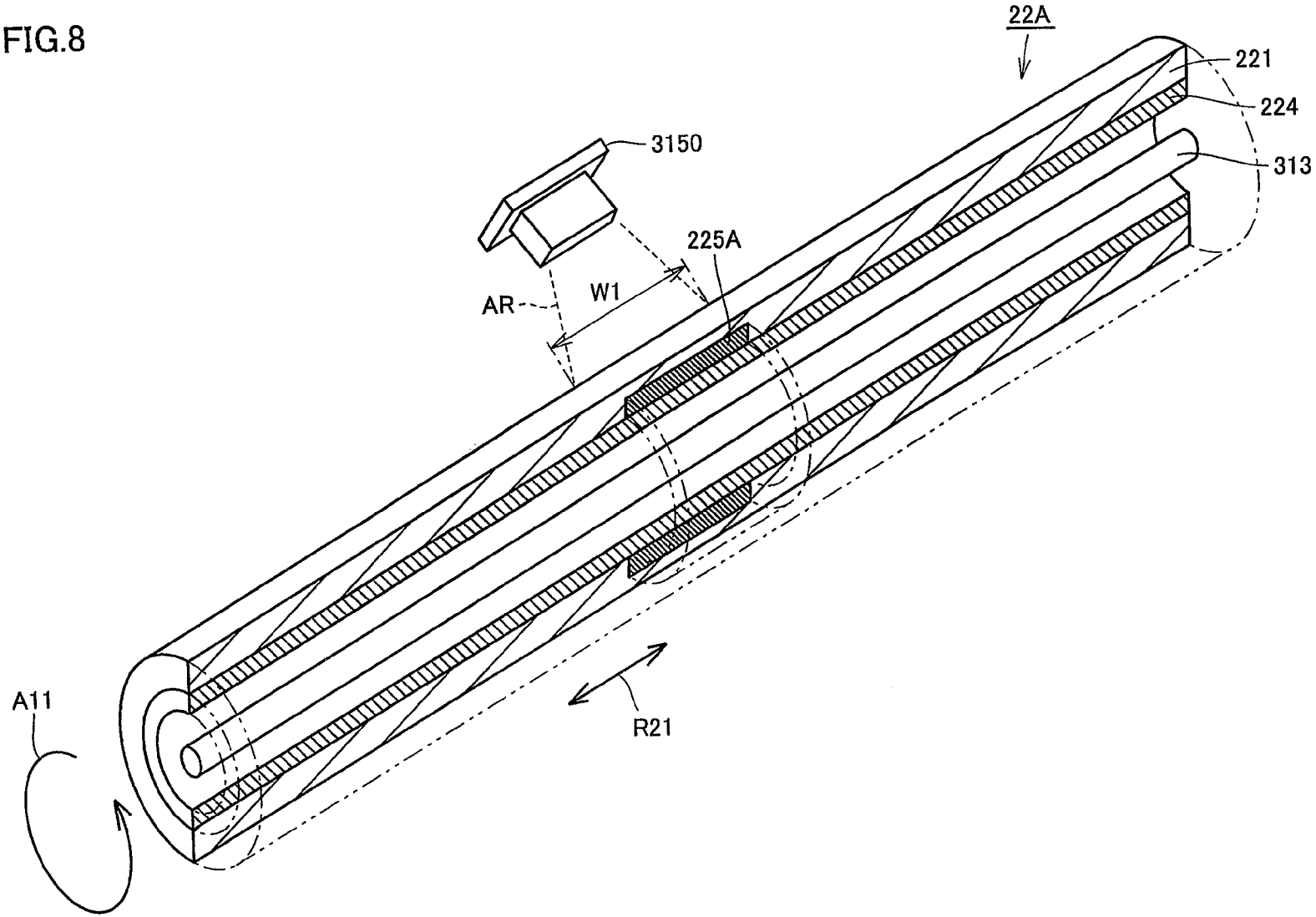
FIG. 8 is a partial cutaway perspective view of a first variant of the heat roller in FIG. 3.
Figure 9:
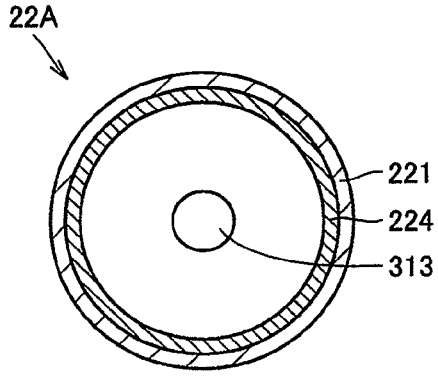
FIG. 9 is a cross-sectional view of a heat roller in FIG. 8.
Figure 10:
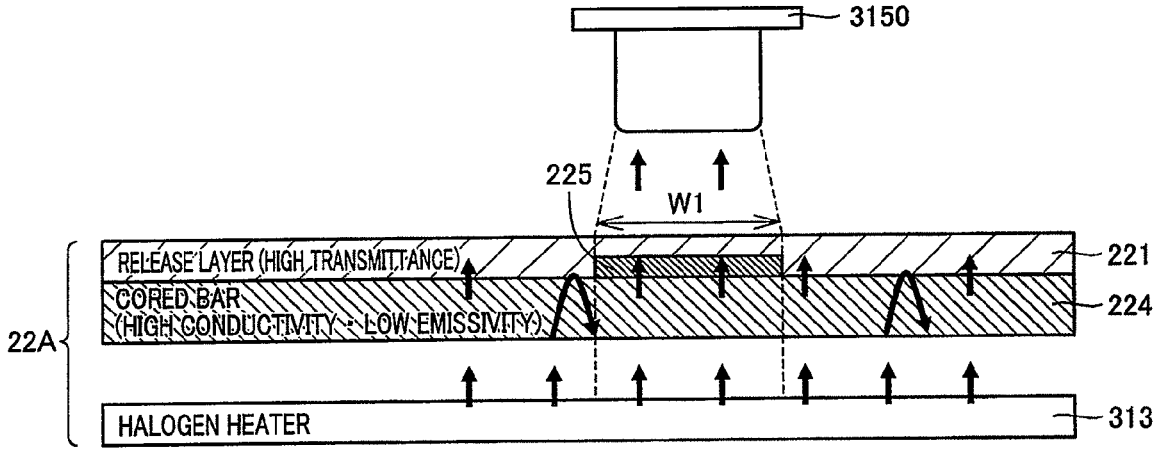
FIG. 10 is a diagram schematically showing a cross-sectional structure of the heat roller in FIG. 8.

FIG. 8 is a partial cutaway perspective view of a heat roller 22A which is a first variant of heat roller 22. FIG. 9 is a cross-sectional view of heat roller 22A. FIG. 10 is a diagram schematically showing a cross-sectional structure of heat roller 22A. An arrow A11 indicates the rotation direction of heat roller 22A.

Heat roller 22A has a halogen heater 313 in a central portion thereof. Halogen heater 313 is contained in a hollow cylindrical cored bar 224.

A release layer 221 is formed on the outside of cored bar 224 without providing an elastic layer 223, as does heat roller 22 described with reference to FIG. 5, etc. A high emissivity layer 225A is provided in a portion of release layer 221 of heat roller 22A in a longitudinal direction of heat roller 22A (double headed arrow R21) facing a temperature detection area of a temperature sensor 3150. Note that high emissivity layer 225A has a size (width W1) in the longitudinal direction of heat roller 22A, and is provided over the entire area in the rotation direction of heat roller 22A.

High emissivity layer 225A is formed, for example, by adding or applying a dye (e.g., a black pigment), a carbon resin, etc., to a surface of release layer 221 (a surface of release layer 221 that faces cored bar 224 and that is opposite to a surface of release layer 221 facing temperature sensor 3150). A material forming high emissivity layer 225A is a material with a higher emissivity of infrared rays in a fusing control temperature range in fusing apparatus 110 than release layer 221, and the emissivity in such a wavelength range (2 to 10 μm) is preferably 0.9 or more. Note that high emissivity layer 225A may be provided, by application, etc., in an appropriate area of an outer surface of cored bar 224 (a surface of cored bar 224 abutting on release layer 221).

In addition, it is preferable that high emissivity layer 225A be provided on a surface (the back side) of release layer 221 opposite to a surface of release layer 221 facing temperature sensor 3150. With this, heat transmitted through cored bar 224 can be efficiently radiated from only a portion of release layer 221 where high emissivity layer 225A is provided.

(2) Effects of the High Emissivity Layer

Figure 13:
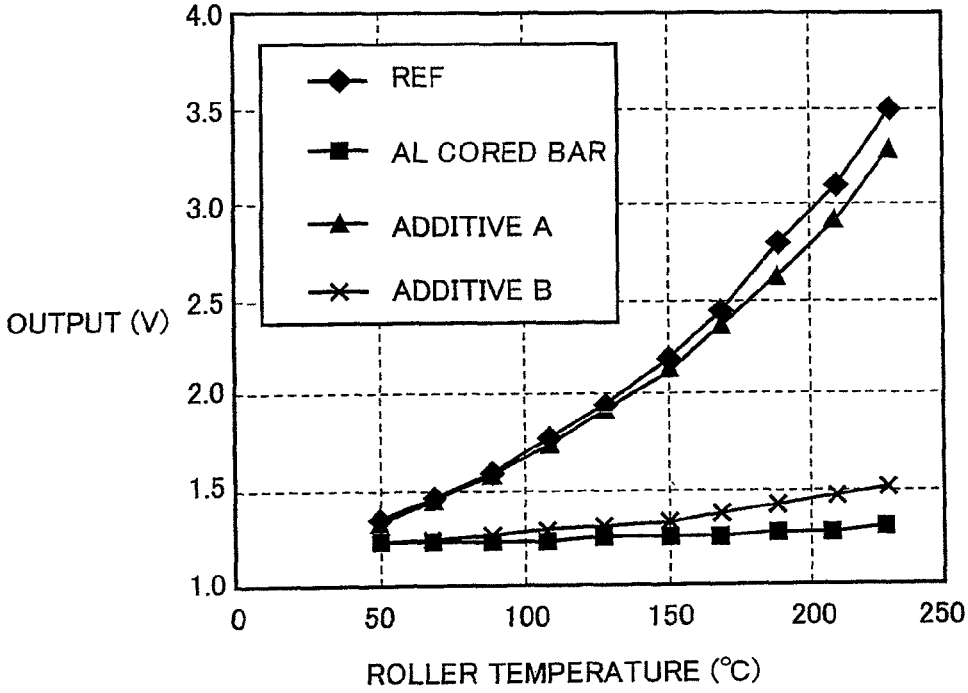
FIG. 13 is a diagram for describing the effects of a high emissivity layer of the heat roller in FIG. 8 for the respective materials used for the high emissivity layer.

FIG. 13 is a diagram for describing the effects of high emissivity layer 225A for the respective materials used for high emissivity layer 225A. In FIG. 13, a horizontal axis (roller temperature) represents the surface temperature of heat roller 22A. This surface temperature is detected for the surface of heat roller 22A (release layer 221) in a non-contact manner, using a temperature sensor different than temperature sensor 3150. On the other hand, a vertical axis (output) represents the voltage value outputted from temperature sensor 3150. Temperature sensor 3150 changes the voltage value outputted therefrom, according to a change in temperature detected.

In FIG. 13, "AL cored bar" represents a detection output from temperature sensor 3150 in a state in which, without providing high emissivity layer 225A, release layer 221 is provided on cored bar 224 whose material is aluminum.

"Additive A" and "additive B" represent detection outputs from temperature sensor 3150 for the case of providing high emissivity layer 225A on cored bar 224 (between cored bar 224 and release layer 221) in a pattern such as that shown in FIG. 8, etc. The "additive A" represents a detection output for the case of applying an additive of a first type (additive A) as high emissivity layer 225A, and the "additive B" represents a detection output for the case of applying an additive of a second type (additive B) as high emissivity layer 225A. Note that the additive A is an additive with a higher content of an oil component than the additive B and with a lower content of a synthetic resin component than the additive B.

In FIG. 13, "REF" represents a conventional configuration and shows data on a heat roller in which an elastic layer made of heat resistant elastic rubber such as silicone rubber or fluorine rubber is formed on a hollow cylindrical cored bar with excellent thermal conductivity, and a release layer is further formed on the elastic layer, i.e., neither a low emissivity layer nor a high emissivity layer is provided, and most of heat other that heat used to melt toner is emitted outside from the release layer by heat radiation.

As is understood from FIG. 13, in the "AL cored bar", even if the surface temperature of heat roller 22A is changed from 50° C. to 230° C., almost no change is observed in detection output from temperature sensor 3150.

On the other hand, in the "additive B" in FIG. 13, the detection output (voltage value) from temperature sensor 3150 makes a bigger change than the "AL cored bar", according to an increase in the surface temperature of heat roller 22A.

In the "additive A", the detection output (voltage value) from temperature sensor 3150 changes according to an increase in the surface temperature of heat roller 22A, and the degree of the change with respect to the increase in surface temperature is higher than that for the "additive B" and is close to that for the "REF".

It can be said that the larger the amount of detection output (voltage value) from temperature sensor 3150 that changes according to an increase in the surface temperature of heat roller 22A, the better the sensitivity of temperature sensor 3150. In image forming apparatus 100, in particular, in fusing apparatus 110, temperature control for fusing of a toner image is performed at 150 to 200° C. Therefore, it is considered that the sensitivity of temperature detection by temperature sensor 3150 needs to be improved in this temperature range.

In FIG. 13, by providing the additive A or the additive B, the sensitivity of temperature detection by temperature sensor 3150 is improved. Note that, in FIG. 13, in the additive A, the detection output from temperature sensor 3150 makes a bigger change with respect to the change in surface temperature than that in the additive B. That is, it can be said that the degree of improvement in the sensitivity of temperature sensor 3150 changes depending on the type of additive.

[5. Second Variant of the Heat Roller]

Figure 11:
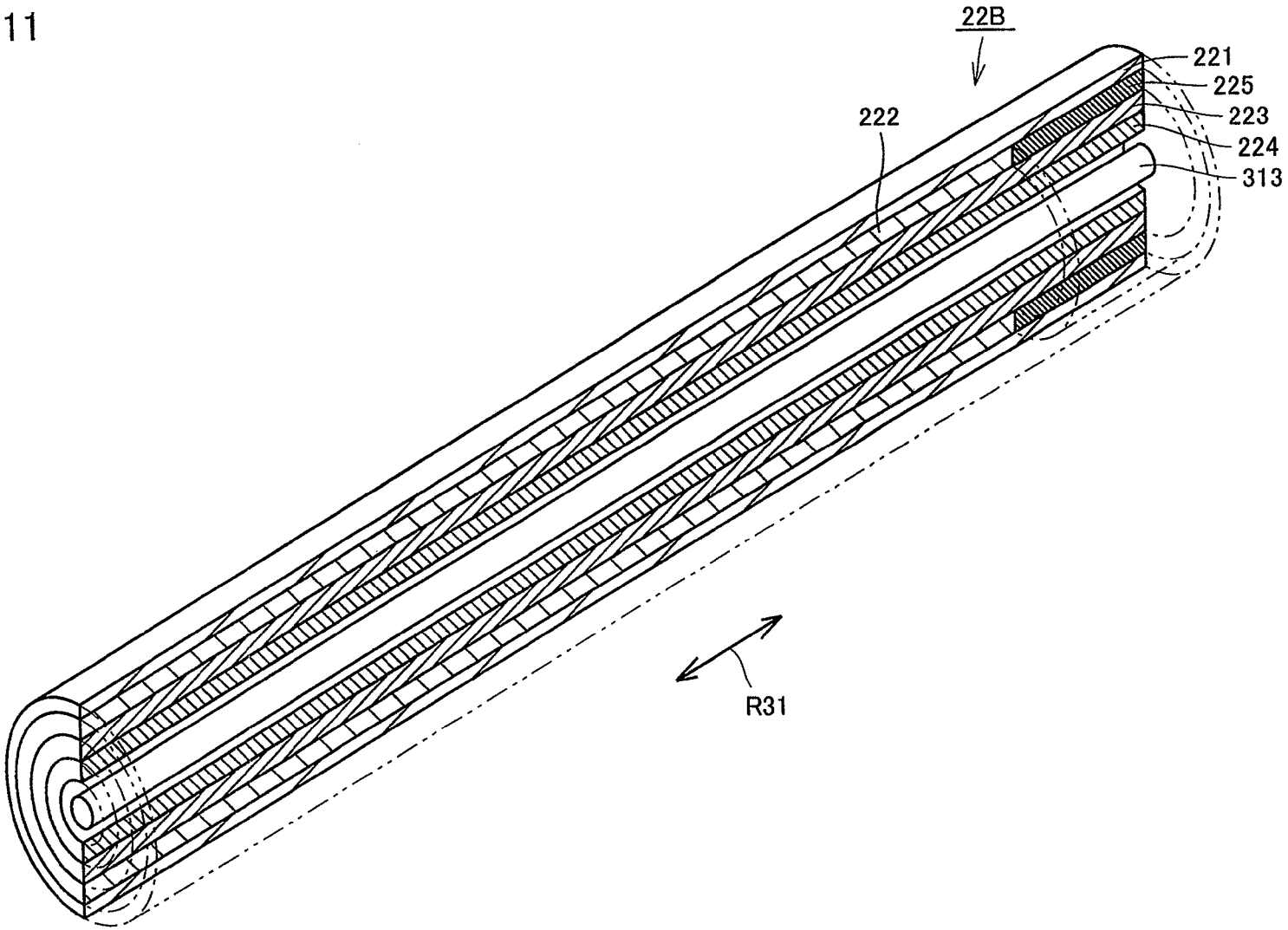
FIG. 11 is a partial cutaway perspective view of a second variant of the heat roller in FIG. 3.
Figure 12:
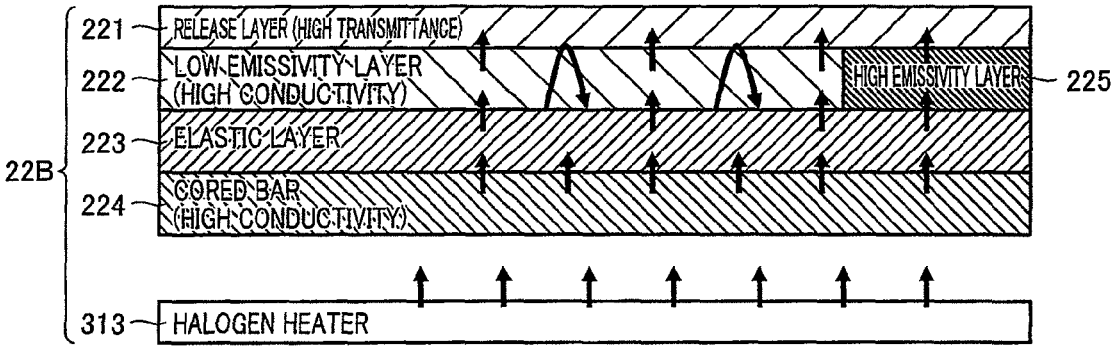
FIG. 12 is a diagram schematically showing a cross-sectional structure of a heat roller in FIG. 11.

FIG. 11 is a partial cutaway perspective view of a heat roller 22B which is a second variant of heat roller 22. FIG. 12 is a diagram schematically showing a cross-sectional structure of heat roller 22B.

In heat roller 22B, a high emissivity layer 225 is provided at an end on one side in a longitudinal direction of heat roller 22B (double headed arrow R31).

In a fusing apparatus employing heat roller 22B, there is a case in which recording paper is allowed to pass through such that an edge of the recording paper is aligned against an end on the other side of heat roller 22B. In this case, when a width in a direction intersecting a transport direction of the recording paper is shorter than a size in the longitudinal direction of heat roller 22B, the end on one side of heat roller 22B does not abut on the recording paper.

In heat roller 22B, high emissivity layer 225 is provided in a portion of heat roller 22B where the likelihood of abutting on recording paper is considered to be relatively low, i.e., the end on one side of heat roller 22B. In such a portion, it is highly likely that the number of times such a portion abuts on recording paper is smaller than that for the other portion and thus it is highly likely that the number of times heat is taken away by recording paper is smaller than that for the other portion. Hence, it is likely that such a portion is higher in temperature than the other portion. Accordingly, heat variations may occur in the longitudinal direction on a surface of heat roller 22B. If heat variations occur, then when recording paper of the same size as the size in the longitudinal direction of heat roller 22B passes through, variations in fusing of toner may occur due to the difference in surface temperature.

In heat roller 22B, high emissivity layer 225 with a relatively high emissivity is provided at the end on one side in the longitudinal direction of heat roller 22B, whereby the cooling efficiency of such a portion is improved.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A fusing apparatus comprising:

a heat member including therein a heat source and having a cylindrical configuration, and heating a recording member, thereby fusing a toner image on said recording member; and a temperature detector for detecting a surface temperature of said heat member in a non-contact manner, wherein a surface of said heat member is configured such that a region of the surface all around said cylindrical configuration that faces a temperature detection area of said temperature detector has a higher emissivity than other regions.

2. The fusing apparatus according to claim 1, wherein said temperature detector is a sensor for performing temperature detection based on an amount of infrared rays received.

3. The fusing apparatus according to claim 1, wherein the surface of said heat member includes:

a release layer abutting on a recording member; and a low emissivity layer covered by said release layer and having a lower emissivity than said release layer, and a region of said low emissivity layer facing the temperature detection area of said temperature detector is replaced by a material with a higher emissivity than a material forming the low emissivity layer.

4. The fusing apparatus according to claim 1, wherein the surface of said heat member includes:

a release layer abutting on a recording member; and a low emissivity layer covered by said release layer and having a lower emissivity than said release layer, and said low emissivity layer is formed except for a region facing the temperature detection area of said temperature detector.

5. The fusing apparatus according to claim 1, wherein said heat member includes a release layer abutting on a recording member, and a region of said release layer facing the temperature detection area of said temperature detector is provided with a material with a higher emissivity than a material forming the release layer.

6. The fusing apparatus according to claim 5, wherein a surface of said release layer opposite to a surface thereof abutting on the recording member is provided with a material with a higher emissivity than the material forming said release layer.

7. An image forming apparatus that forms an image on a recording member, the image forming apparatus comprising: a fusing apparatus according to claim 1.

8. An image forming apparatus that forms an image on a recording member, the image forming apparatus comprising: a fusing apparatus according to claim 2.

9. An image forming apparatus that forms an image on a recording member, the image forming apparatus comprising: a fusing apparatus according to claim 3.

10. An image forming apparatus that forms an image on a recording member, the image forming apparatus comprising: a fusing apparatus according to claim 4.

11. An image forming apparatus that forms an image on a recording member, the image forming apparatus comprising: a fusing apparatus according to claim 5.

12. An image forming apparatus that forms an image on a recording member, the image forming apparatus comprising: a fusing apparatus according to claim 6.

* * * * *